US008319082B1

(12) United States Patent
Bacon

(10) Patent No.: US 8,319,082 B1
(45) Date of Patent: Nov. 27, 2012

(54) STRINGED INSTRUMENT KEYBOARD

(76) Inventor: George Donald Bacon, Westminster, CO (US)

( * ) Notice: Subject to any disclaimer, the term of this patent is extended or adjusted under 35 U.S.C. 154(b) by 212 days.

(21) Appl. No.: 12/924,825

(22) Filed: Oct. 7, 2010

Related U.S. Application Data

(60) Provisional application No. 61/279,544, filed on Oct. 22, 2009.

(51) Int. Cl.
*G10D 1/08* (2006.01)
*G10D 3/04* (2006.01)
*G10D 3/06* (2006.01)

(52) U.S. Cl. ..... 84/314 R; 84/315

(58) Field of Classification Search ..... 84/314 R, 84/315
See application file for complete search history.

(56) References Cited

U.S. PATENT DOCUMENTS

| | | | | |
|---|---|---|---|---|
| 730,000 | A | | 6/1903 | Buchanan |
| 745,557 | A | | 12/1903 | Baker |
| 1,094,038 | A | | 4/1914 | Weaver et al. |
| 1,207,213 | A | | 12/1916 | Re |
| 1,219,884 | A | | 3/1917 | Thingstad |
| 1,374,388 | A | | 4/1921 | Reed |
| 1,437,026 | A | | 11/1922 | Spartivento |
| 2,429,138 | A | | 10/1947 | Ruf |
| 2,450,210 | A | | 9/1948 | Sprague |
| 2,744,433 | A | | 5/1956 | Rooms |
| 3,805,664 | A | | 4/1974 | Starns |
| 3,915,051 | A | | 10/1975 | Kincaid |
| 3,995,523 | A | | 12/1976 | Clarke |
| 4,030,400 | A | | 6/1977 | Del Castillo |
| 4,061,069 | A | * | 12/1977 | Brackett ..... 84/315 |
| 4,195,546 | A | | 4/1980 | Urbank |
| 4,222,303 | A | | 9/1980 | Kryzanowsky |
| 4,331,059 | A | | 5/1982 | Marabotto |
| 4,363,256 | A | | 12/1982 | Smith |
| 4,417,497 | A | * | 11/1983 | Nicklaus ..... 84/485 R |
| 4,545,282 | A | | 10/1985 | Arnett et al. |
| 4,566,365 | A | | 1/1986 | Huston, Jr. |
| 4,665,789 | A | | 5/1987 | Papadatos |
| 5,831,189 | A | | 11/1998 | Edlund |
| 6,753,466 | B1 | | 6/2004 | Lee |

* cited by examiner

*Primary Examiner* — Jeffrey Donels
(74) *Attorney, Agent, or Firm* — Linda Flewellen Gould

(57) ABSTRACT

A stringed instrument keyboard consists of a plate secured above a fingerboard of an instrument with multiple keys uniquely arranged on that plate. Each key consists of a rectangular key top, a key shaft extending downward from the key top through an access hole in the plate toward the fingerboard, and a key tip attached to the opposite end of the key shaft suitable for depressing an instrument string against a particular fret on the fingerboard. Pressing the key top causes the associated key tip to apply pressure to the string beneath that key in an opportune position to hold the string against an adjacent fret. Thumb levers may be used to depress certain keys. The keyboard facilitates learning how to play a stringed instrument, by simplifying the manipulation required to hold strings in appropriate positions and minimizing the pain associated with holding strings with finger tips.

9 Claims, 14 Drawing Sheets

STRINGED INSTRUMENT KEYBOARD

REFERENCE TO RELATED APPLICATIONS

This is a non-provisional application for the invention disclosed in U.S. Provisional Application Ser. No. 61/279,544 filed Oct. 22, 2009.

BACKGROUND OF THE INVENTION

1. Field of the Invention

The present invention relates to a specialized keyboard which is secured above the fingerboard of a stringed instrument, such as a guitar. Keys are arranged on the keyboard to allow a user to press one or more keys to cause strings to be depressed at desired positions on the fingerboard.

2. Description of the Prior Art

While many people desire to learn to play a stringed instrument, such as an acoustic guitar, electric guitar, bass, banjo, or mandolin, two obstacles deter many people from mastering a stringed instrument. As is readily apparent to anyone who has attempted to play a guitar, pressing each string on the fingerboard in the manner required to play a particular note or chord is initially painful. Until one has played the instrument enough to develop calluses on the tips of fingers of the fingering hand, those fingers hurt as the musician is learning to play. Second, manipulating the fingers to press strings of the instrument in exactly the right positions to play desired notes and chords is difficult. Because the strings of the instrument are close together, much practice is required to hold the strings in proper positions without affecting adjacent strings.

A number of devices are known in the prior art to attempt to overcome these obstacles. For example, a variety of chord-playing keyboards have been fashioned to allow someone learning to play a stringed instrument to press a particular key or set of keys on the keyboard and thereby cause multiple strings of the instrument to be depressed at the appropriate positions on the fingerboard of the instrument to cause particular chords to be played when the instrument is strummed. Such devices include U.S. Pat. Nos. 1,094,038 to Weaver et al., 1,219,884 to Thingstad, 2,450,210 to Sprague, 3,805,664 to Starns, 3,915,051 to Kincaid, 3,995,523 to Clarke, 4,030,400 to Del Castillo, 4,195,546 to Urbank, 4,363,256 to Smith, 4,545,282 to Arnett et al., 4,566,365 to Huston, Jr., 4,665,789 to Papadatos, 5,831,189 to Edlund, 4,331,059 to Marabotto, and 6,753,466 to Lee. While some of these devices achieve the purpose of simplifying the hand manipulation required to sound particular chords, these chord-playing devices may actually impede learning how to play the instrument. If the music student relies on pressing a particular key to sound a chord, that student has not learned which strings and positions are necessarily depressed to cause that chord to be played if the chord-playing device is not available. Furthermore, these devices restrict the ability of the musician to play any notes or chords other than the chords which the device is dedicated to playing. The device must be removed from the instrument if a chord is to be played which is not included in the finite number of chords which are playable with the device.

Other devices known in the prior art attempt to overcome these obstacles to learning to play a stringed instrument without limiting the playing process in the manner of the chord-playing keyboards. For example, U.S. Pat. No. 745,557 to Baker, U.S. Pat. No. 1,374,388 to Reed, U.S. Pat. No. 1,437,026 to Spartivento and U.S. Pat. No. 4,222,303 to Kryznowsky each teach a keyboard attachment with raised, cylindrical keys which may be pressed to depress strings of the instrument in select positions under the keyboard. Similarly, U.S. Pat. No. 730,000 to Buchanan, U.S. Pat. No. 1,207,213 to Re, U.S. Pat. No. 2,429,138 to Ruf, and U.S. Pat. No. 2,744,433 to Rooms each describe keyboards with six non-touching buttons across the area of the fingerboard between each set of frets. While these devices have the beneficial effect of minimizing the pain associated with using finger tips to depress strings onto the instrument fingerboard, the finger manipulation required to play particular chords may actually be more difficult than fingering the strings directly on the fingerboard of the instrument. In the case of devices with cylindrical, raised keys, playing particular chords may be more difficult because the keys are significantly raised above the keyboard. In the case of keyboards utilizing six non-touching buttons across each row between frets, the buttons are necessarily very small and difficult to uniquely depress.

A stringed instrument keyboard is needed which reduces the pain associated with holding strings on the fingerboard with fingertips, facilitates finger placement for holding multiple strings in appropriate positions for sounding chords, and allows the user to learn proper finger placement for chord playing. Such a keyboard will make it easier to learn to play a stringed instrument, and thus has the potential to permit many would-be musicians to embark on a journey of actually playing music despite some of the obstacles which have previously prevented that accomplishment.

SUMMARY AND OBJECTS OF THE INVENTION

A primary object of the present invention is to provide a method of playing a stringed instrument without being deterred by finger tip pain such as occurs when the stringed instrument is played in a traditional manner.

Another object of the present invention is to provide a method of playing all notes and chords which it is possible to play on a stringed instrument in a manner which is greatly simplified when compared to traditional playing methods.

Yet another object of the present invention is to provide a stringed instrument keyboard which significantly reduces the difficulty inherent in the finger manipulations required in the playing of a standard stringed instrument.

Still another object of the present invention is to provide such a keyboard which easily allows the user's thumb on the chord forming hand to participate in the playing of individual notes and the forming of chords in a manner not currently possible in the playing of a stringed instrument.

These objects are achieved by a keyboard consisting of a plate secured above a fingerboard of a stringed instrument with multiple keys uniquely arranged on the keyboard. Each key consists of a rectangular key top, a key shaft extending downward from the key top through an access hole in the keyboard toward the fingerboard of the instrument, and a key tip attached to the opposite end of the key shaft suitable for depressing an instrument string against a particular fret on the fingerboard. Each key shaft beneficially extends from the exact point on the underside of the key top which is aligned directly above the string to be depressed by that key in a position either immediately behind a fret on which the string is to be depressed or substantially mid-way between that fret and an adjacent fret. In this manner, pressing the key top causes the associated key tip to apply pressure to the string in an opportune position to hold the string against the fret, thereby changing the vibrating length of the string and altering its pitch.

The plate has a shape substantially corresponding to the shape of the fingerboard above which the plate is suspended. The plate can be configured to cover all or some portion of the fingerboard, depending on whether it is desirable for the keyboard to cover the entire fingerboard or just to control the strings over a portion of the keyboard. A significantly thicker segment of the plate may beneficially be provided at the end which is secured above the nut of the instrument, so that the plate rests on that nut at a desired elevation clearing the strings.

Numerous mechanisms may be used to suspend and secure the plate above the fingerboard. In addition to causing a thicker end of the plate to rest on the nut of the instrument, support pegs or other supporting framework can be attached to the underside of the plate, extending toward the surface of the fingerboard. Such supports conveniently rest on the top side of the fingerboard, and are carefully positioned so as not to touch the strings either when the strings are at rest or vibrating. Clamping mechanisms may be used to secure either end of the plate to the fingerboard, again provided that the mechanism does not interfere with the strings. In a preferred embodiment, vertical edges are provided extending down from either side of the plate to corresponding sides of the fingerboard, providing an aesthetically pleasing barrier to debris which might otherwise get between the fingerboard and the plate. One or more clamping mechanisms may be secured to each vertical edge and to the underside of the fingerboard to securely hold the keyboard in place.

From a conceptual standpoint, it is convenient to think of the keyboard as being arranged in rows, with each row corresponding to the area between adjacent frets on the fingerboard immediately below that area of the keyboard. Each row is divided into two sub-rows or strips, each of which strips has a length approximately half of the length of the row. The plate of the keyboard may conveniently be arranged in channels, with two sets of channels per row (corresponding to the area between adjacent frets), or one set of channels per strip. The number of channels in each strip is preferably one-half the number of strings on the instrument. Thus, by way of example, a keyboard for a six-string guitar will have six channels formed in the keyboard above each area between adjacent frets, with three channels in the first strip of that row and three channels in the second strip of that row. Each individual channel is rectangular, to accommodate movement of a rectangular key top vertically within that channel. The top of the plate may then have a honeycomb appearance, with separate channels or compartments to hold each key top arranged in the plate.

The rectangular key top for each key has length and width dimensions which fit securely into the channel for that key. Thus the channels prevent the key tops from twisting by assuring that each key top remains flat as it is pressed, so that the key shaft under the key top is pressed directly down onto an instrument string. Placement of the key tops in individual channels also forces the keys to be moved in a straight up and down motion, minimizing the possibility of keys becoming stuck in an awkward orientation.

Each channel, and thus each key top which fits into an individual channel, is beneficially sized and arranged so that each channel is flush against all adjacent channels. This allows the musician to hold down multiple adjacent keys with one finger, greatly simplifying the fingering required to play certain chords. To accomplish this feature, each channel ideally has its own unique size, and each rectangular key top has a corresponding unique size which fits perfectly into the channel in a manner that allows the key top to be moved up and down within the channel without any movement in any other direction. The length of each unique channel is determined by the length which is appropriate to cover an area which is approximately half the length between the adjacent frets which establish the row in which that key resides. The width of each channel is selected to enable three key tops to fit in the strip in which that channel is formed, while providing an area under each key top that will support the key shaft extending downward to a position most favorable for depressing the string so as to make proper contact with the fret which is adjacent to that point on the string and between that point and the body of the instrument. Because the fingerboard of the instrument is frequently more narrow at some points than at others, and the distance between frets varies from one fret area to another, each channel ideally has unique dimensions required to fit within the length and width of the fret area beneath the row of that channel, while maximizing the area available for each key top in that row.

An access hole is formed in the keyboard beneath each channel, allowing a key shaft to be moved downward through that access hole toward the fingerboard of the instrument. To fully utilize the area between each set of adjacent frets and thereby maximize the size of each key top, access holes are arranged in each row in staggered positions. A first set of access holes is positioned in a first strip immediately behind the fret on which the string is to be depressed and a second set of access holes is positioned in the second strip approximately mid-way between that fret on which the string is to be depressed and the adjacent fret further away from the body of the instrument. Thus, using as an example a six string guitar, this staggered arrangement of access holes in each row of the keyboard results in each row having two strips of three access holes each, with each access hole designed to allow a key to depress one of the six strings of the guitar over any given fret area. Three access holes in one strip are ideally lined up substantially over the mid-way points of the first, third, and fifth strings, while the other three access holes are ideally lined up immediately behind the frets of the second, fourth and sixth strings. The three access holes over the first, third, and fifth strings may beneficially be placed somewhat closer to the fret than the actual mid-way point between frets, minimizing the amount of pressure required to depress the string on that fret. In this manner, the access holes are staggered within a row, but placed to minimize the pressure required to depress each key, thus making it easier to play the instrument.

The position at which each string is most advantageously depressed by a key tip will differ from string to string, based on the distance between where the string is depressed and the fret against which the string makes contact. Depending on the distance between the point on the string where it is depressed and the fret against which the string is making contact, the string must flex different amounts to make solid contact with the fret. If the key is accessing the string through an access hole which is mid-way between two frets, it is necessary to cause the string to flex so as to make solid contact with the fret. In contrast, if the key is accessing the string through an access hole which is close to a fret, then it is possible to depress the string directly onto the fret, thereby causing the string to flex to a much lesser degree than is the case when the strings are depressed at a point approximately mid-way between the frets. Therefore, the length of the key shaft for keys which are mid-way between frets is beneficially longer, to provide for a longer stroke and more flex of the string being depressed, than the key shaft for keys aligned close to a fret. The length of the key shaft also beneficially takes into account the unique thickness of each of the strings of the instrument. Therefore, each string of the instrument is ideally depressed by keys which have the unique key shaft length which accommodates these differences in a way that allows the string to properly contact the adjacent fret.

By tailoring the length of each key shaft, it is possible to ensure that the top of all key tops within the fingerboard rests at the same elevation with respect to the keyboard. Furthermore, the position of each depressed key is beneficially the same level with respect to the keyboard. Thus, the starting level and ending level of each key in the keyboard is advantageously uniform, facilitating quick and smooth transitions from one chord to another.

Each key shaft is aligned under its respective key top in a manner that allows that key shaft to extend downward at a substantially right angle from the key top, in a position most advantageous for squarely holding the string beneath that key against the fingerboard. This is achieved by extending each key shaft from the point of its key top which is directly above the position at which the string is to be depressed. To accomplish this, each key is preferably uniquely designed to fit a particular position on the keyboard. While the key top of each key is designed to maximize the size of each key top and allow for adjacent key tops to be played by a single finger, the position of the key shaft will be determined by what position allows the string beneath the key to be depressed at the best possible position for clarity of tone. As a result, for most keys, the key shaft will not be centered under the key top but rather will be off-centered.

While the key top and key shaft are beneficially constructed of rigid materials, such as metal or plastic, it is advantageous to construct the key tip of a pliable material, such as rubber or soft plastic covered by felt. In this manner the sound created by the key tip holding the string in place is similar to that which would be achieved by a finger tip holding the string.

A number of positioning mechanisms may be used for returning the key to its original position within its channel of the plate when the key top is no longer pressed. In a preferred embodiment, a spring surrounds an indented or narrow portion of the key shaft above the plate. When the key is pressed downward, the spring is compressed between the underside of the key top and the top of the plate, and remains compressed as long as the key top is pressed to hold the string against the fingerboard. When the musician ceases pressing the key top, the compressed spring expands, thereby pushing the key to its original position. It is beneficial to provide a retaining mechanism, such as a ring or C clip around a portion of the key shaft under the plate, to prevent the key shaft from being pushed higher than its original position in the plate by the positioning mechanism.

Thumb levers may advantageously be provided to enable the musician to depress certain strings by using the thumb. These thumb levers greatly enhance a beginning player's experience with the instrument when the thumb levers are provided on the side of the plate corresponding to the side of the fingerboard on which strings are customarily depressed by the fourth or fifth fingers. Because the thumb is typically stronger than the fourth and fifth fingers, and because extending the fourth or fifth finger into positions across the fingerboard can be difficult, chords which require depressing the strings with the fourth or fifth finger can be achieved more easily when a thumb lever is used. Thus, thumb levers make it significantly easier to play the instrument than using any traditional method.

In a preferred embodiment, a compartment for the thumb levers is provided along one side of the plate. The compartment consists of opposite sides which extend downward from a side of the plate at either end of the keyboard. A thumb lever rod is inserted through matching holes in the compartment sides so that the rod is substantially parallel to the side of the plate. Each thumb lever may advantageously consist of three parts: a thumb lever centerpiece, a thumb lever tip, and a thumb lever activator. A hole is formed through the thumb lever centerpiece for receiving the rod, so that each thumb lever centerpiece pivots around the rod. The thumb lever activator extends from one end of the thumb lever centerpiece, so that a user may cause the thumb lever to pivot around the rod by engaging the thumb lever activator with the user's thumb. The thumb lever tip extends from the other end of the thumb lever centerpiece, above a key on the plate adjacent to the thumb lever, so that the thumb lever tip depresses that key when the thumb lever centerpiece is caused to pivot around the rod.

Figure 1:
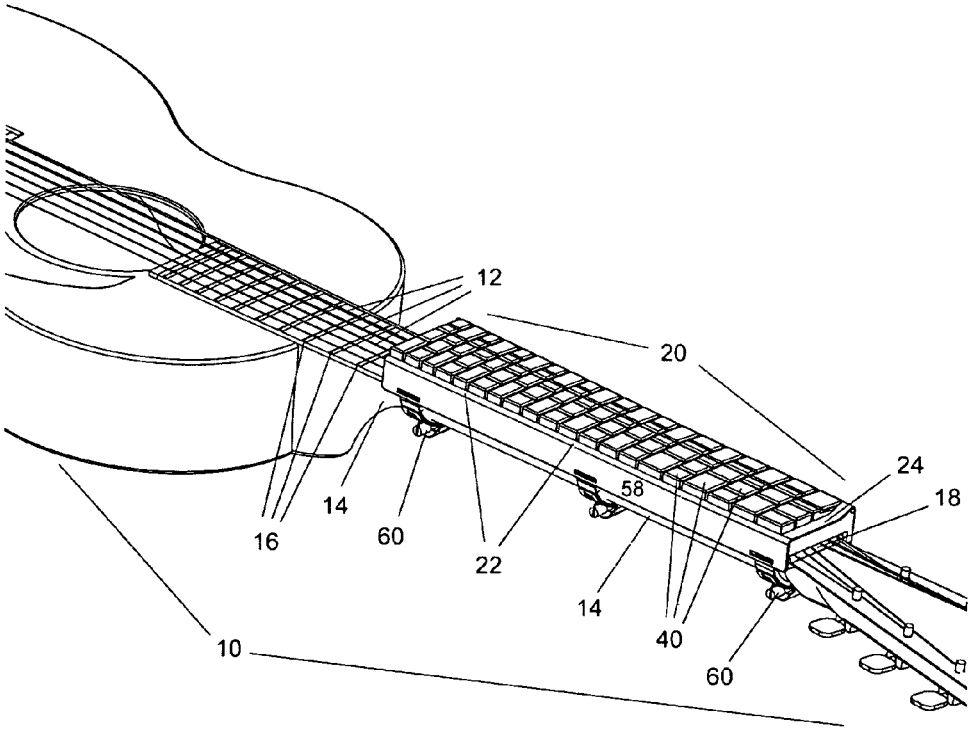
FIG. 1 is a right side and top perspective view of a stringed instrument keyboard attached to the fingerboard of a stringed instrument, according to the present invention.

In the drawings, the following legend has been used:

| | |
|---|---|
| 10 | Stringed Instrument |
| 12 | Strings |
| 14 | Fingerboard |
| 16 | Frets |
| 18 | Nut |
| 20 | Keyboard |
| 22 | Plate |
| 24 | Top of plate |
| 26 | Bottom of plate |
| 28 | Side of plate |
| 29 | Row of plate |
| 30 | First strip |
| 31 | Second Strip |
| 32 | Access hole |
| 34 | First set of access holes near frets |
| 36 | Second set of access holes mid-way between frets |
| 38 | Key Channel in top of plate |
| 40 | Key |
| 42 | Key top |

-continued

| | |
|---|---|
| 44 | Key shaft |
| 46 | Key tip |
| 48 | Positioning means |
| 50 | Spring |
| 52 | Indentation in key shaft |
| 54 | C Ring |
| 56 | Support peg |
| 58 | Vertical edge |
| 60 | Clamp |
| 62 | Thumb lever |
| 64 | Thumb lever compartment |
| 66 | Thumb lever centerpiece |
| 68 | Thumb lever tip |
| 70 | Thumb lever activator |
| 72 | Thumb lever rod |
| 74 | Side of thumb lever compartment |
| 76 | Hole in side of thumb lever compartment side |

DESCRIPTION OF THE PREFERRED EMBODIMENT

The present invention provides a stringed instrument keyboard for depressing strings on an instrument in a manner that decreases the pain and difficulty of learning to play the instrument. In the following description, numerous specific details are set forth in order to provide a thorough understanding of the present invention. It will be obvious, however, to one skilled in the art that the present invention may be practiced without these specific details. Some well-known methods and structures have not been set forth in order not to unnecessarily obscure the description of the present invention.

Figure 3:
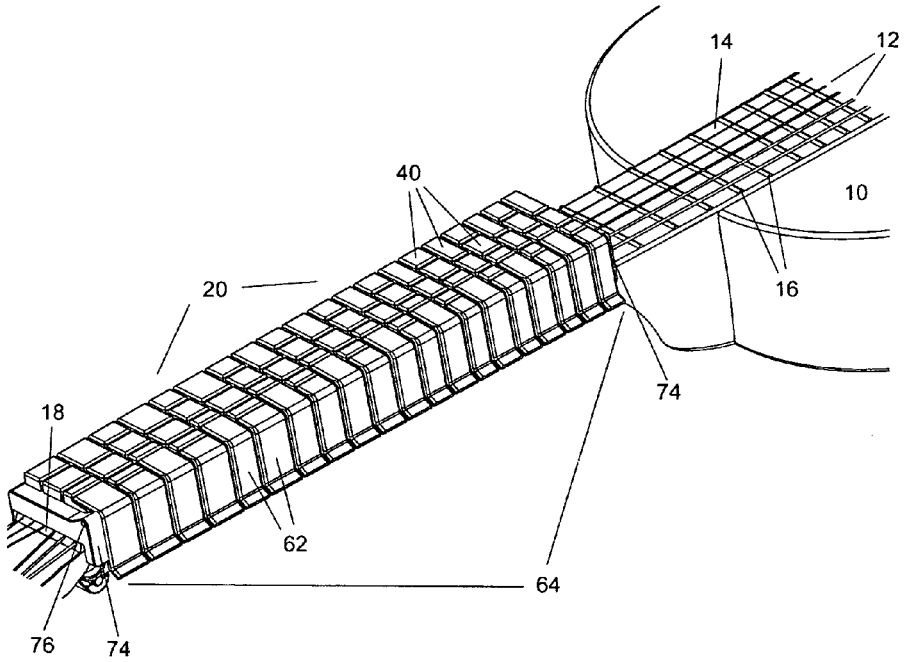
FIG. 3 is a left side and top perspective view of the stringed instrument keyboard attached to a fingerboard.
Figure 7:
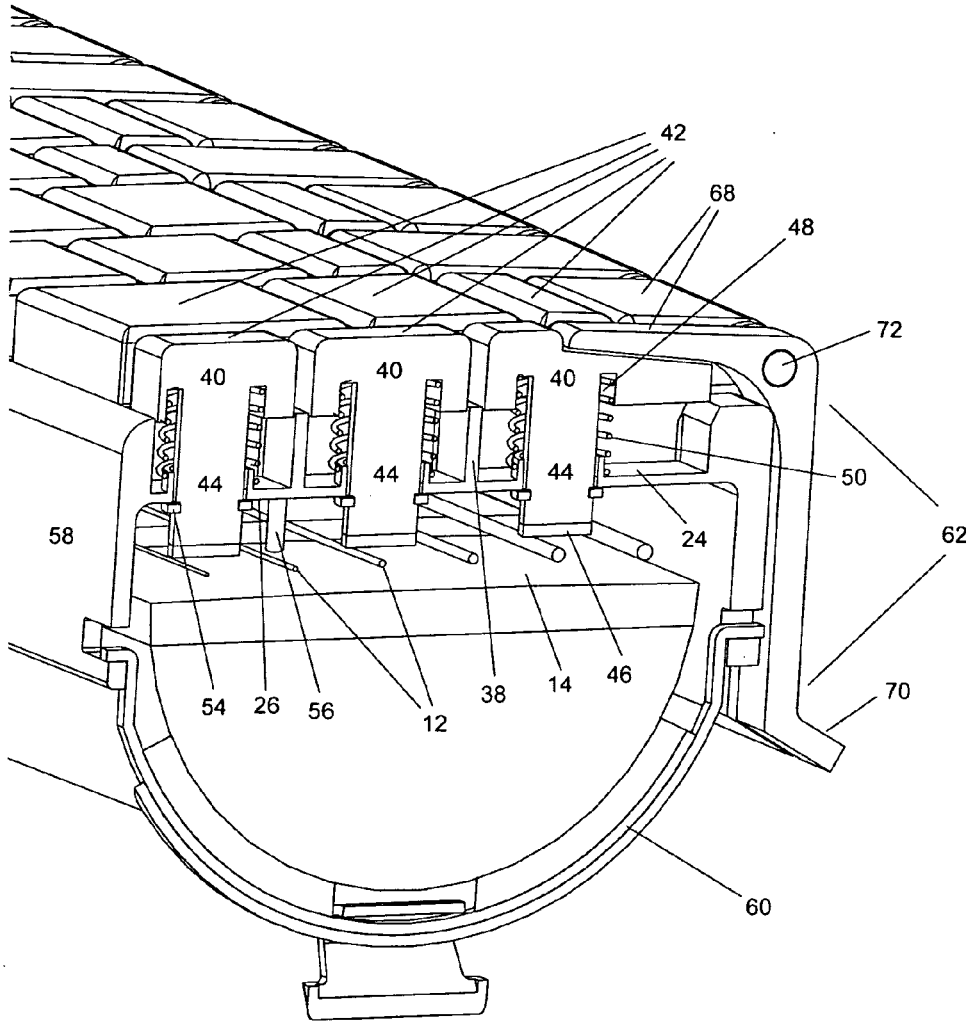
FIG. 7 is a front perspective view of the stringed instrument keyboard of the present invention.
Figure 8:
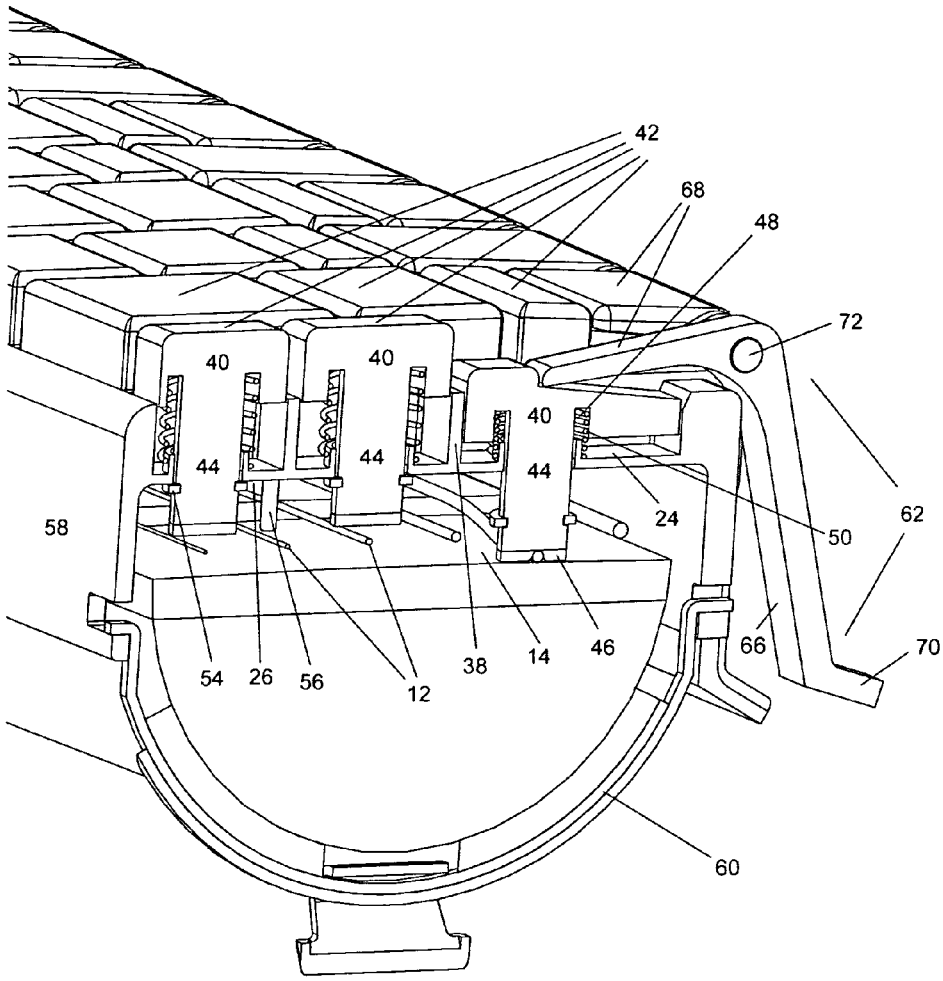
FIG. 8 is a front perspective cut-away view of the stringed instrument keyboard, attached to a fingerboard, showing one key depressed by activation of a thumb lever.
Figure 9:
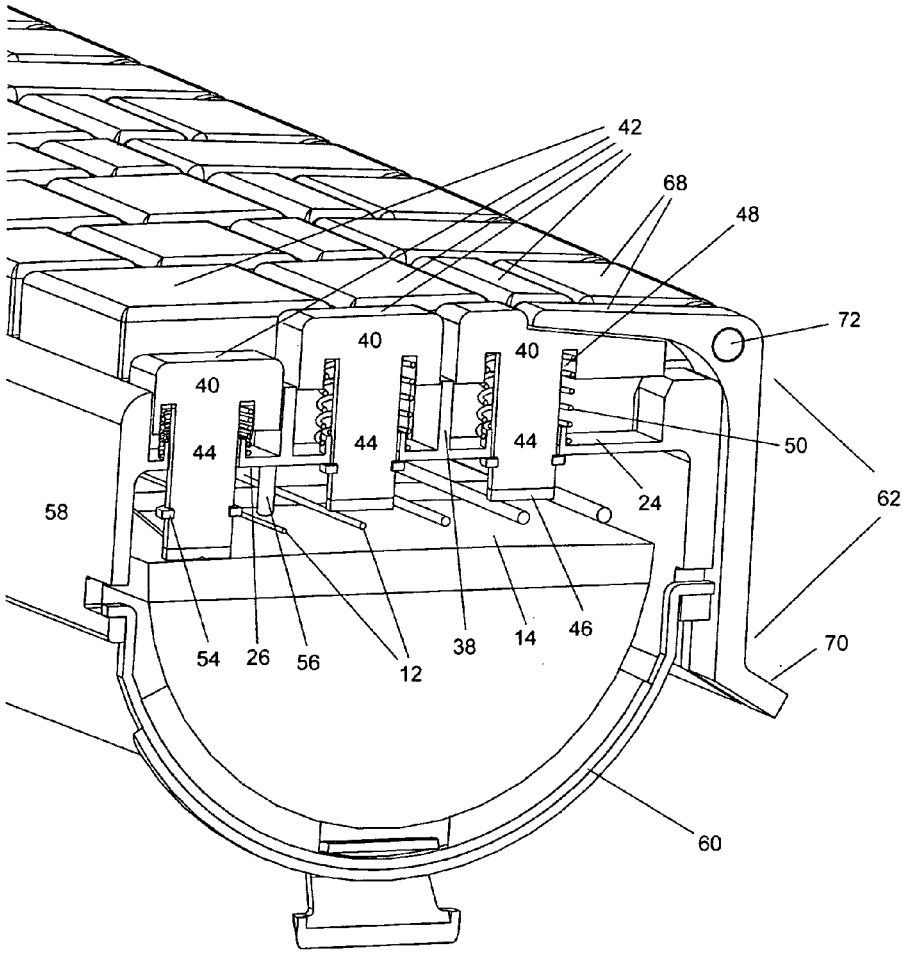
FIG. 9 is a front perspective cut-away view of the stringed instrument keyboard, attached to a fingerboard, showing one key depressed.

As shown in FIGS. 1 and 3, the stringed instrument keyboard 20 of the present invention fits on top of all or a portion of a fingerboard 14 of a stringed instrument 10. The keyboard 20 is securely suspended above the strings 12 and frets 16 of the fingerboard 14. The keyboard 20 may be held in place by a clamping mechanism 60, by a thickened area of the keyboard 20 resting on the nut 18 of the instrument 10, or by a number of other securing mechanisms known in the prior art. For example, support pegs 56 extending vertically between the fingerboard 14 and the bottom 26 of the keyboard 20, as shown in FIGS. 7 and 8, may be used to secure the keyboard 20 at a desired elevation above the fingerboard 14, so that the keyboard 20 does not interfere with the vibration of the strings 12 on the fingerboard 14. A vertical edge 58 may extend downwards from each side 28 of the plate 22 for use with the clamping mechanism 60.

Figure 5:
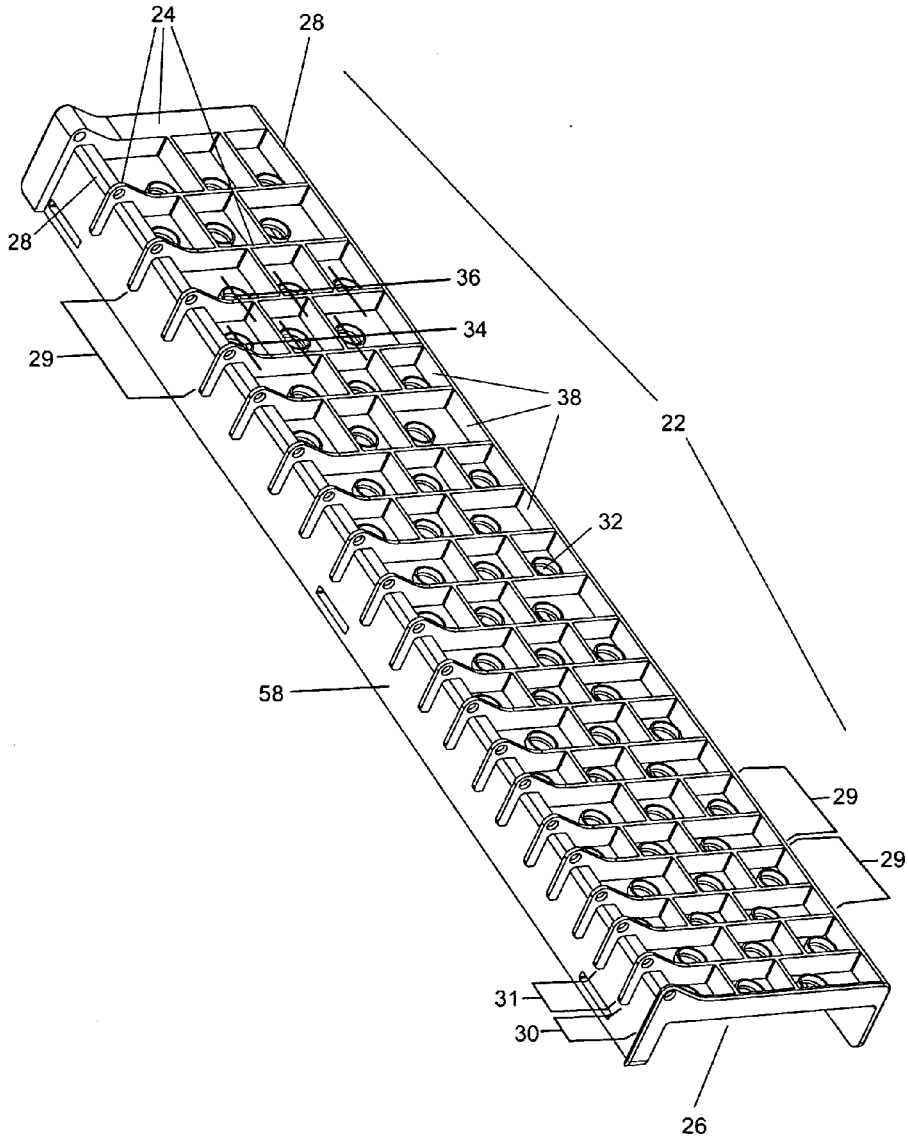
FIG. 5 is a left side and top perspective view of the stringed instrument keyboard, shown without keys.

The keyboard 20 consists of a plate 22 and keys 40. As best shown in FIG. 5, the plate 22 has a top 24, bottom 26, and opposing sides 28. The plate 22 has multiple rows 29, each of which rows 29 corresponds to an area on the fingerboard 14 between adjacent frets 16 immediately below that row 29. Access holes 32 are formed in the plate 22 so that each row 29 of the keyboard 20 has a separate access hole 32 directly above each of the instrument strings 12 beneath that row 29.

The access holes 32 are staggered in each row 29 to create a first set of access holes 34 nearest a fret 16 against which each string 12 may be held, and a second set of access holes 36 substantially in between adjacent frets 16. Thus, for each pair of adjacent strings 12 under a row 29 of the keyboard 20, one string 12 can be accessed through an access hole 32 in the first set of access holes 34 and the other string 12 can be accessed through an access hole 32 in the second set of access holes 36. Conceptually it may be useful to consider each row 29 as consisting of two sub-rows or strips, 30, 31; a first strip 30 in which the first set of access holes 34 are formed and a second strip 31 in which the second set of access holes 36 are formed.

Figure 10:
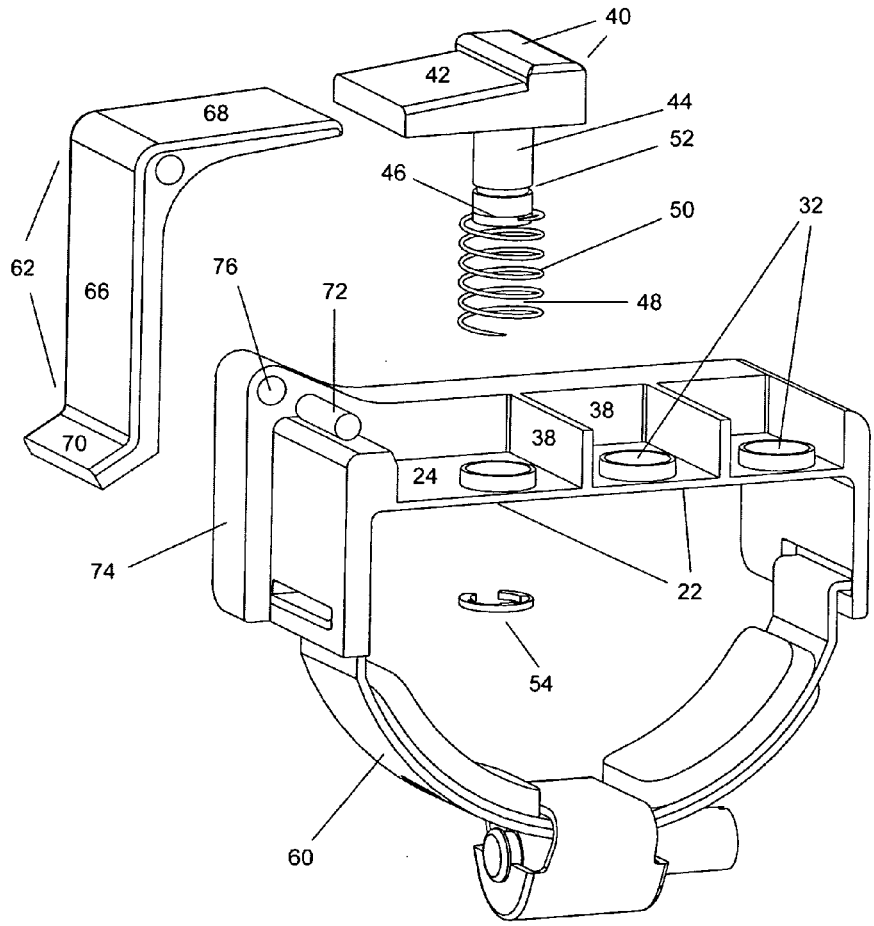
FIG. 10 is an exploded view of a portion of the stringed instrument keyboard.

A key 40 is inserted through each access hole 32. As best shown in FIGS. 7 and 10, each key 40 has a key top 42, a key shaft 44, and a key tip 46. When the key 40 is manually depressed by pushing the key top 42 downward, the key tip 46 is depressed onto the string 12, holding the string 12 at an appropriate place on the fingerboard 14 to cause the string 12 to contact an adjacent fret 16, thereby changing the vibrating length of the string and altering its pitch.

Figure 14:
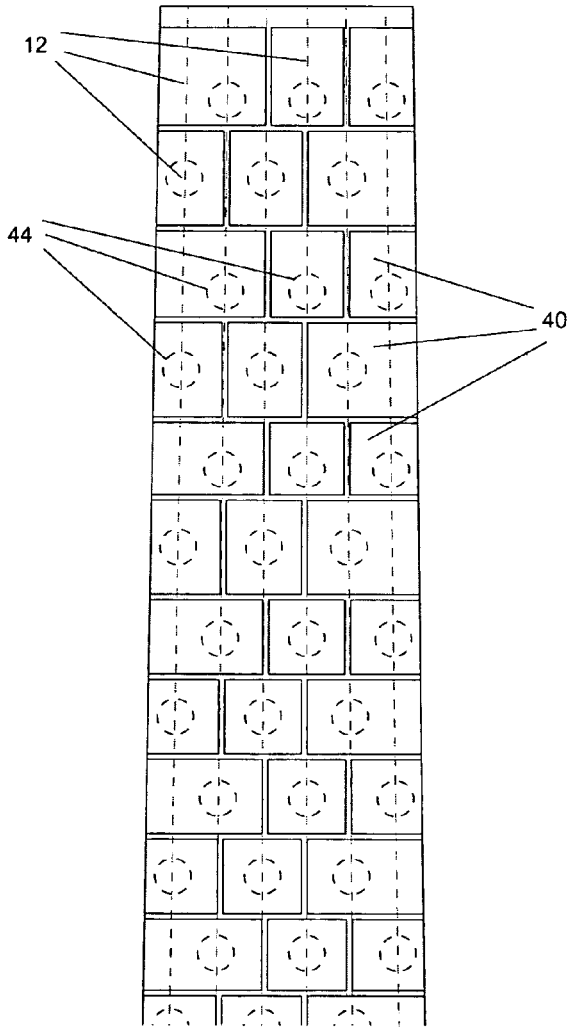
FIG. 14 is a top transparent view of the stringed instrument keyboard.

Each key shaft 44 is ideally positioned beneath its key top 42 to depress the string 12 beneath that key 40 at an advantageous point to hold the string 12 against a fret 16. The most advantageous position for each key shaft 44 may not be directly under the center of the key 40, and thus some of the key shafts 44 extend from an area of the key top other than the center, as best shown in FIG. 14. Channels 38 formed in the plate 22 hold each key top 42 in place and prevents twisting of the key top 42 so that the key 40 may only move in a straight up and down direction.

Figure 6:
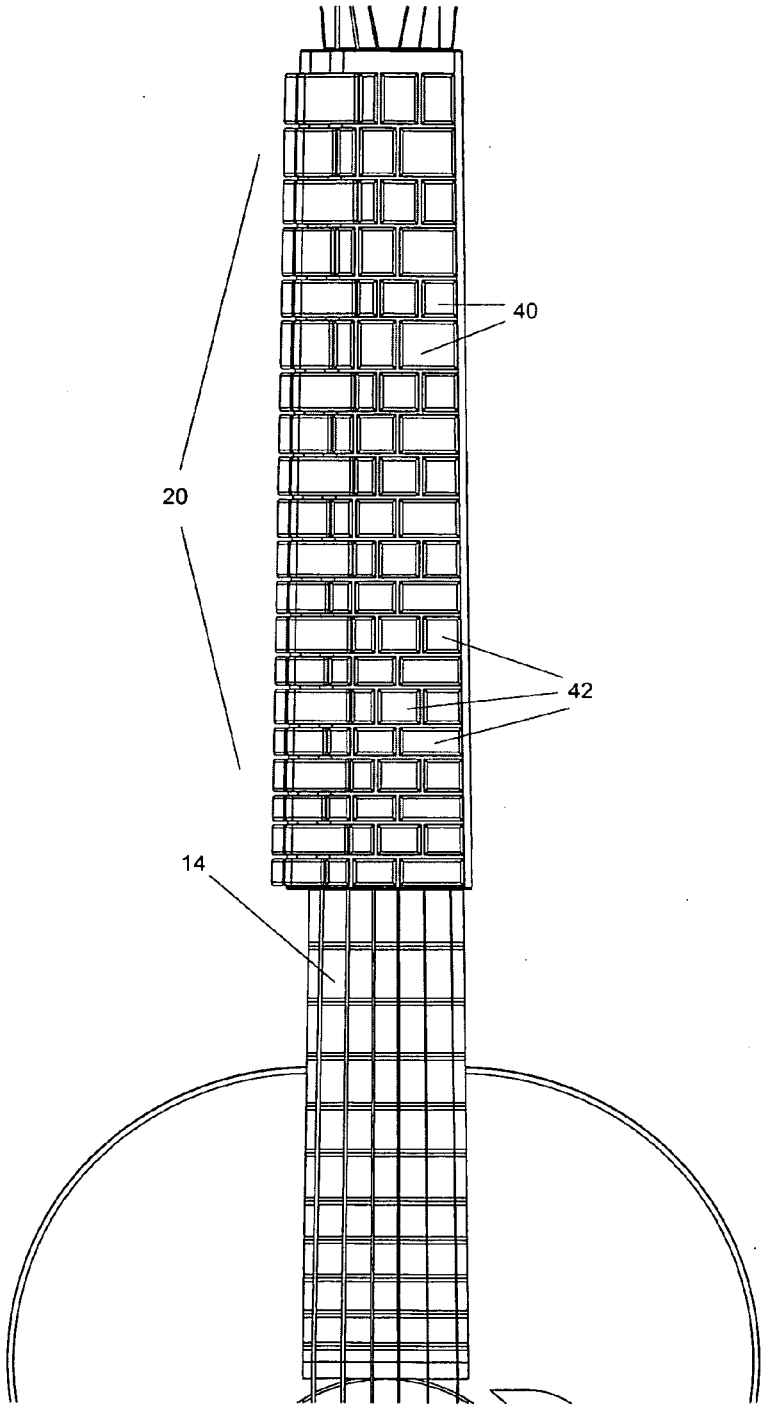
FIG. 6 is a top view of the stringed instrument keyboard attached to a fingerboard.
Figure 11:
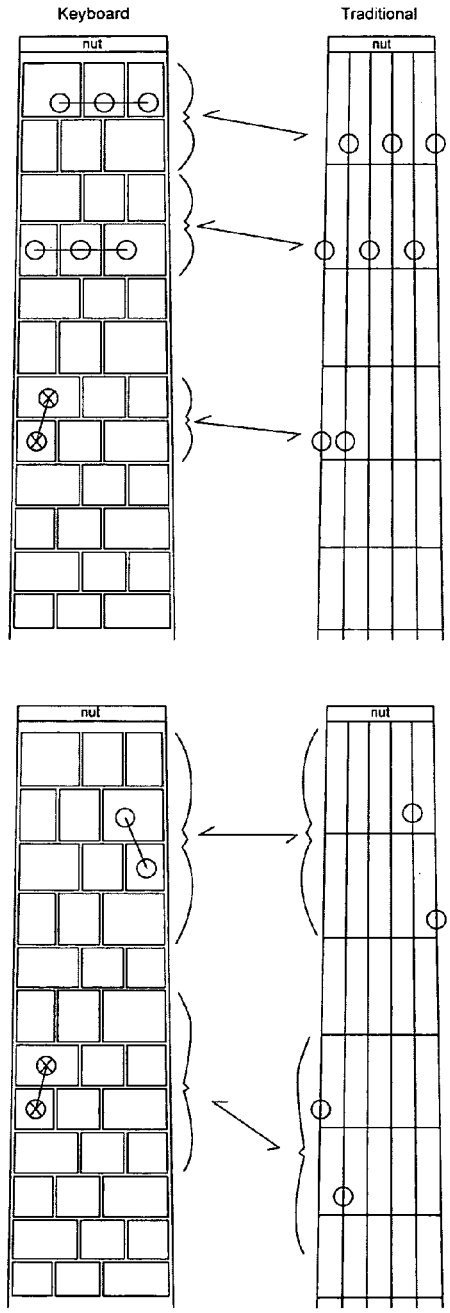
FIG. 11 consists of two charts comparing fingering required to depress particular strings at particular fret positions, with and without using the stringed instrument keyboard of the present invention.
Figure 12:
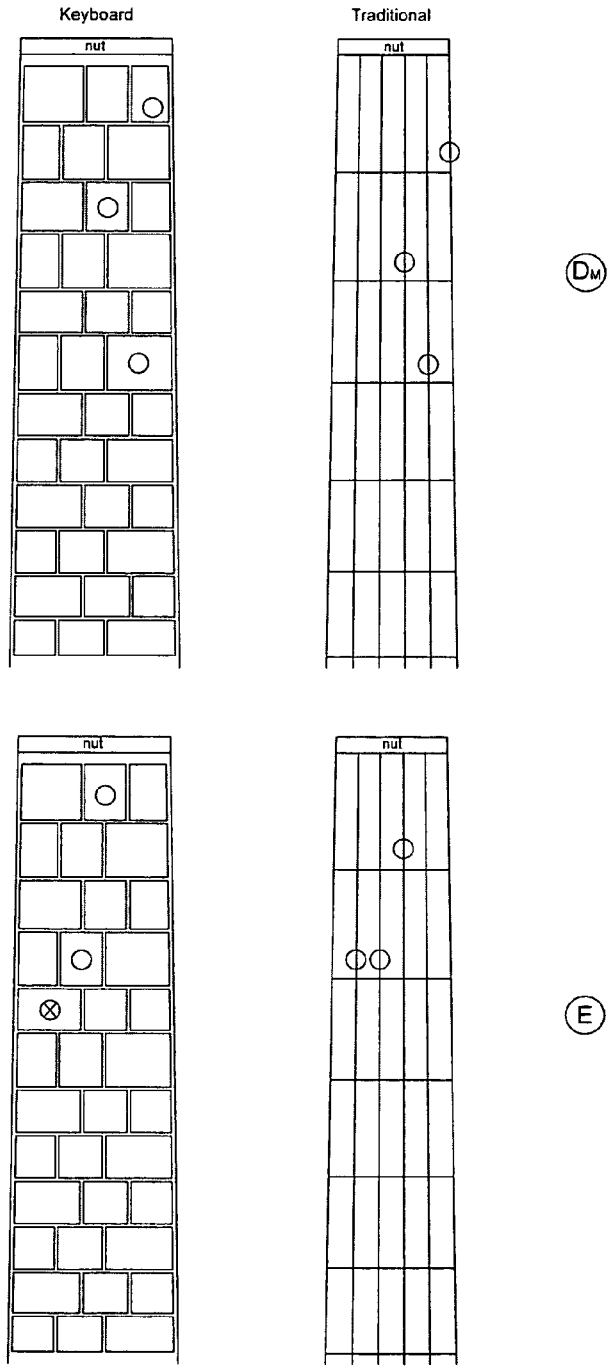
FIG. 12 and FIG. 13 are charts showing fingering required for typical chords on a guitar, both with and without using the stringed instrument keyboard of the present invention.

The key tops 42 are rectangular and designed to fit in a flush manner with respect to all adjacent key tops 42, as shown in FIG. 6. This construction advantageously permits the musician playing the instrument 10 to depress multiple strings 12 in different positions with a single finger. This advantage over traditional methods of playing a keyboard instrument 10 is illustrated by the finger charts of FIGS. 11, 12, and 13. For example, FIG. 11 compares the traditional method of holding down non-adjacent strings behind a single fret 16 on a six string instrument with the manner in which this is accomplished using the claimed invention. In the traditional mode, three fingers must carefully be placed on each string 12, so as not to disturb the strings 12 between the three non-adjacent strings 12. However, when the claimed keyboard 10 is used, a single finger may be held across a set of keys 40 which are aligned behind the fret 16. Similarly, two fingers must be carefully placed on two adjacent strings 12 in the traditional manner of playing a stringed instrument 10. These same adjacent strings 12 can be depressed behind a single fret 16 by holding down adjacent keys 40 with a single finger.

In fact, as illustrated in FIG. 11, in some situations it is possible with the claimed keyboard 10 to depress different strings 12 behind different frets 14 using the same finger. Because the keys 40 used to depress certain strings 12 in particular positions are adjacent, a single finger can be used to depress, for example, the second string 12 behind the first fret 16 and the first string 12 behind the second fret 16. Similarly, a single finger can be used to depress the sixth string 12 behind the fourth fret 16 and the fifth string 12 behind the fifth fret 16. Using an alternate mechanism described later in this section, these same strings 12 could be depressed in these same positions by engaging adjacent thumb levers 62 with the user's thumb, as graphically represented by the x's in FIG. 11.

The usefulness of the claimed keyboard 20 for a beginning student musician becomes particular apparent when comparing how some standard guitar chords are played using traditional methods and using the keyboard 20. As illustrated in the top graph of FIG. 12, a D minor chord is played in the traditional method by depressing three strings 12 at three different positions. This same D minor chord is played using the keyboard 20 by depressing three separate keys 40, which is considerably less painful for non-calloused finger tips than the traditional method. As illustrated in the bottom graph of FIG. 12, an E chord is played in the traditional method by using three fingers to hold down three strings 12 in three particular positions. While three keys 40 must be depressed to play the E chord using the keyboard 20, one of those keys 40 may be depressed using a thumb lever 62, as shown by the "x" in the fingering position, which may be dramatically easier to accomplish than manipulating the ring finger or pinkie to the appropriate string 12 using the traditional fingering method.

Figure 13:
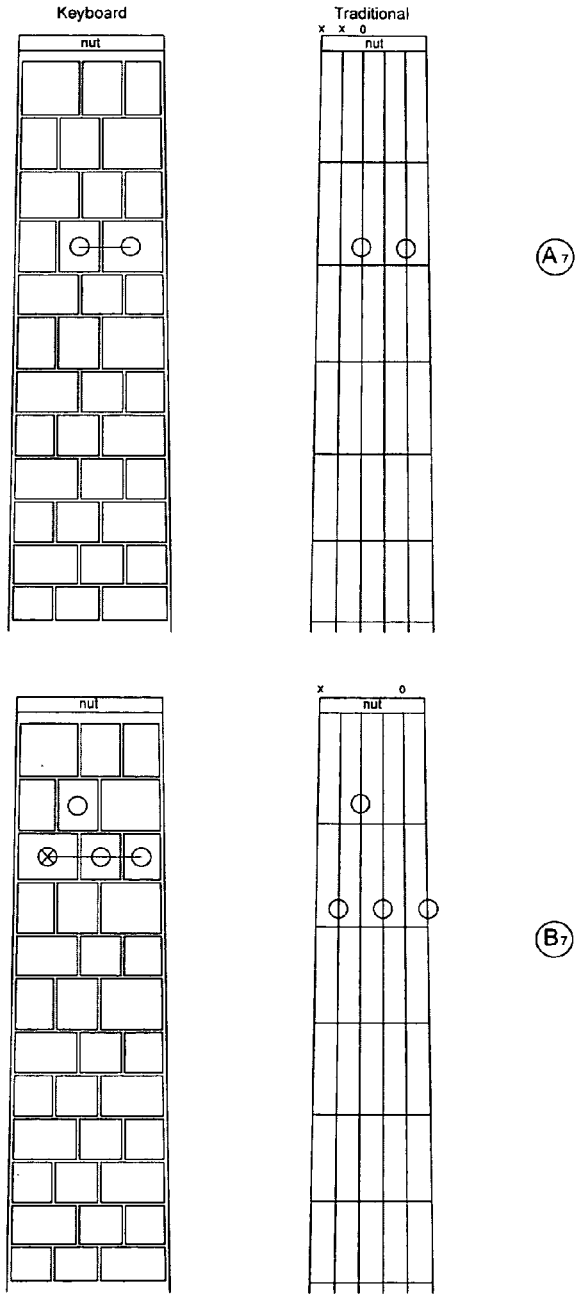

Similarly, as shown in FIG. 13, an $A_7$ chord is played with two fingers in the traditional method, but can be played with a single finger depressing adjacent keys 40 using the keyboard 20. A $B_7$ chord requires four fingers depressing four keys in the traditional method, but can be accomplished with two fingers, one of which depresses three adjacent keys 40, using the keyboard 20. The ease with which these basic chords can be played can encourage a beginning musician and minimize the possibility of the musician giving up on the instrument 10.

Figure 2:
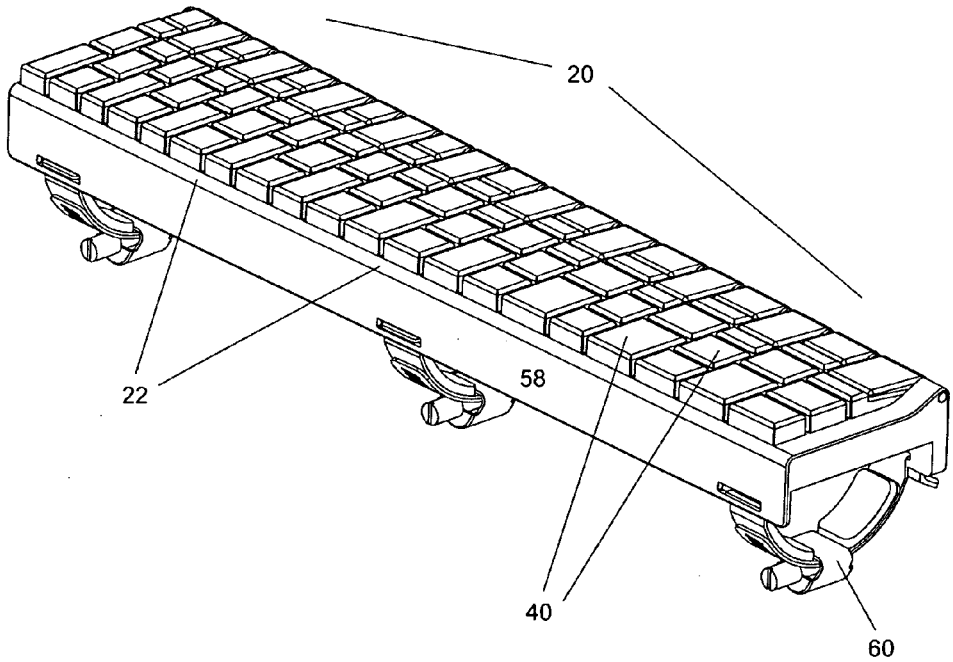
FIG. 2 is a right side and top perspective view of the stringed instrument keyboard of the present invention.
Figure 4:
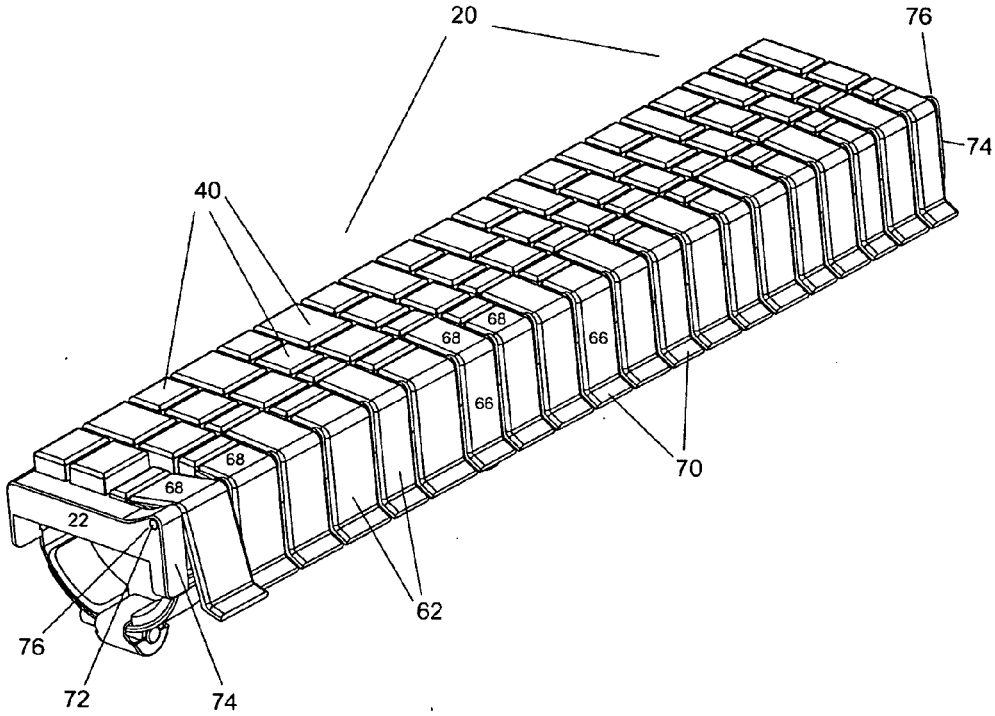
FIG. 4 is a left side and top perspective view of the stringed instrument keyboard.

As shown in FIGS. 2 and 4, the rectangular key tops 42 have different sizes and dimensions. Each key top 42 is designed to fit beside each adjacent key 40, so that multiple adjacent keys 40 may be depressed by a single finger, and so that each key top 42 is a maximum possible size to allow ease of fingering. The length and width of each key top 42 is uniquely chosen to fit the area on top of the plate 22 into which the key top 42 resides, and to support the key shaft 44 which extends downward from the key top 42 toward the string 12 in the best possible location for squarely depressing the string 12 beneath that key 40 in a position that allows for clear playing of the string 12.

The key 40 ends in a key tip 46 which is most beneficially constructed of a pliable substance such as rubber or felt covered plastic. A positioning mechanism 48, such as the spring 50 shown in FIGS. 8 and 10, forces the key 40 back to its original position when it is no longer depressed by the user's finger. A C-ring 54 held in an indentation 52 in the key shaft 44 or other retaining mechanism prevents the key 40 from being moved upwards out of the access hole 38.

Thumb levers 62 may ideally be utilized to depress strings 12 which would traditionally be depressed by the $4^{th}$ or $5^{th}$ fingers. As best shown in FIGS. 4 and 8, each thumb lever 62 consists of a thumb lever centerpiece 66, a thumb lever tip 68 for depressing an adjacent key 40, and a thumb lever activator 70 to be engaged by the user's thumb. When the thumb lever 62 is engaged, the thumb lever 62 pivots on the thumb lever rod 72, causing the thumb lever tip 68 to depress the adjacent key 40. The thumb levers 62 may be aligned within a thumb lever compartment 64, the sides 74 of which have matching holes 76 through which the rod 72 is inserted.

It may be useful to provide a depressed area of those key tops 42 which may be depressed by a thumb lever 62, as best shown in FIG. 10. In this manner, the thumb lever tip 68 is placed over the depressed portion of key top 42 so that the thumb lever tips 68 are level with the key tops 42, while the thumb lever tip 68 sits over the lower area of the key top 42. A portion of the key top 42 which is not depressed may still be manually depressed by the user's finger without using the thumb lever 62.

Although the present invention has been described in terms of the presently preferred embodiment, it is to be understood that such disclosure is purely illustrative and is not to be interpreted as limiting. Consequently, without departing from the spirit and scope of the invention, various alterations, modifications, or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

I claim:

1. A keyboard for depressing strings of a stringed instrument having a fingerboard with frets, comprising:

a. a plate securely suspended above the fingerboard of the stringed instrument, said plate having a bottom above the fingerboard, a top opposite thereto, and two sides, b. said plate having a plurality of rows, each row having dimensions corresponding to an area of the fingerboard beneath that row between adjacent frets of the fingerboard, c. each said row having one access hole formed therein above each string of the stringed instrument, said access holes arranged so that a first set of access holes in each row is positioned substantially near a fret and a second set of access holes in each row is positioned substantially mid-way between two frets, such that for each pair of adjacent strings, one string can be accessed through an access hole which is positioned substantially near a fret and the other string can be accessed through an access hole which is positioned substantially mid-way between two frets, d. a plurality of keys arranged within rectangular channels formed in adjacent positions in said top of said plate, each key comprising:

i. a rectangular key top held within each rectangular channel, ii. a key shaft extending downward from the key top through an access hole, and iii. a key tip attached to the key shaft opposite the key top, said key tip being suitable for depressing a string against the fingerboard when the key is pressed, and e. positioning means for raising the key to an original position not touching a string when the key is not pressed, f. wherein each rectangular key top has unique dimensions.

2. A keyboard for depressing strings of a stringed instrument having a fingerboard with frets, comprising:

a. a plate securely suspended above the fingerboard of the stringed instrument, said plate having a bottom above the fingerboard, a top opposite thereto, and two sides, b. said plate having a plurality of rows, each row having dimensions corresponding to an area of the fingerboard beneath that row between adjacent frets of the fingerboard, c. each said row having one access hole formed therein above each string of the stringed instrument, said access holes arranged so that a first set of access holes in each row is positioned substantially near a fret and a second set of access holes in each row is positioned substantially mid-way between two frets, such that for each pair of adjacent strings, one string can be accessed through an access hole which is positioned substantially near a fret and the other string can be accessed through an access hole which is positioned substantially mid-way between two frets, d. a plurality of keys arranged within rectangular channels formed in adjacent positions in said top of said plate, each key comprising:

i. a rectangular key top held within each rectangular channel, ii. a key shaft extending downward from the key top through an access hole, and iii. a key tip attached to the key shaft opposite the key top, said key tip being suitable for depressing a string against the fingerboard when the key is pressed, and e. positioning means for raising the key to an original position not touching a string when the key is not pressed, f. wherein each key shaft above a single string has a unique length which differs from a unique length of each key shaft above each other string.

3. A keyboard according to claim 2, wherein the unique length of each key shaft corresponds to thickness of the string beneath that key shaft and distance between the key tip connected to that key shaft and a fret on which a string beneath that key shaft is being depressed.

4. A keyboard for depressing strings of a stringed instrument having a fingerboard with frets, comprising:

a. a plate securely suspended above the fingerboard of the stringed instrument, said plate having a bottom above the fingerboard, a top opposite thereto, and two sides, b. said plate having a plurality of rows, each row having dimensions corresponding to an area of the fingerboard beneath that row between adjacent frets of the fingerboard, c. each said row having one access hole formed therein above each string of the stringed instrument, said access holes arranged so that a first set of access holes in each row is positioned substantially near a fret and a second set of access holes in each row is positioned substantially mid-way between two frets, such that for each pair of adjacent strings, one string can be accessed through an access hole which is positioned substantially near a fret and the other string can be accessed through an access hole which is positioned substantially mid-way between two frets, d. a plurality of keys arranged within rectangular channels formed in adjacent positions in said top of said plate, each key comprising:

i. a rectangular key top help within each rectangular channel, ii. a key shaft extending downward from the key top through an access hole, and iii. a key tip attached to the key shaft opposite the key top, said key tip being suitable for depressing a string against the fingerboard when the key is pressed, and e. positioning means for raising the key to an original position not touching a string when the key is not pressed, f. wherein said plate is securely suspended above the fingerboard by a plurality of support pegs extending downward from said bottom of said plate to engage the fingerboard of the stringed instrument in a manner that does not touch the strings, each such support peg having a height sufficient to suspend said plate a desired height above the fingerboard so that each key tip does not touch a string when the key of that key tip is in said original position and each key tip does press a string when the key of that key tip is pressed.

5. A keyboard according to claim 4, wherein said plate is further securely suspended above the fingerboard by at least one clamp connecting said plate to the fingerboard and holding said plate at said desired height.

6. A keyboard according to claim 4, further comprising:

a. a vertical edge extending from each side of said plate downward to opposite sides of the fingerboard, and b. clamping mechanism connecting each edge to the fingerboard.

7. A keyboard for depressing strings of a stringed instrument having a fingerboard with frets, comprising:

a. a plate securely suspended above the fingerboard of the stringed instrument, said plate having a bottom above the fingerboard, a top opposite thereto, and two sides, b. said plate having a plurality of rows, each row having dimensions corresponding to an area of the fingerboard beneath that row between adjacent frets of the fingerboard, c. each said row having one access hole formed therein above each string of the stringed instrument, said access holes arranged so that a first set of access holes in each row is positioned substantially near a fret and a second set of access holes in each row is positioned substantially mid-way between two frets, such that for each pair of adjacent strings, one string can be accessed through an access hole which is positioned substantially near a fret and the other string can be accessed through an access hole which is positioned substantially mid-way between two frets, d. a plurality of keys arranged within rectangular channels formed in adjacent positions in said top of said plate, each key comprising:

i. a rectangular key top held within each rectangular channel, ii. a key shaft extending downward from the key top through an access hole, and iii. a key tip attached to the key shaft opposite the key top, said key tip being suitable for depressing a string against the fingerboard when the key is pressed, and e. positioning means for raising the key to an original position not touching a string when the key is not pressed, f. wherein at least one key shaft extends downward from the key top to which said key shaft is attached at a position which is not centered with respect to said key top.

8. A keyboard for depressing strings of a stringed instrument having a fingerboard with frets, comprising:

a. a plate securely suspended above the fingerboard of the stringed instrument, said plate having a bottom above the fingerboard, a top opposite thereto, and two sides, b. said plate having a plurality of rows, each row having dimensions corresponding to an area of the fingerboard beneath that row between adjacent frets of the fingerboard, c. each said row having one access hole formed therein above each string of the stringed instrument, said access holes arranged so that a first set of access holes in each row is positioned substantially near a fret and a second set of access holes in each row is positioned substantially mid-way between two frets, such that for each pair of adjacent strings, one string can be accessed through an access hole which is positioned substantially near a fret and the other string can be accessed through an access hole which is positioned substantially mid-way between two frets, d. a plurality of keys arranged within rectangular channels formed in adjacent positions in said top of said plate, each key comprising:

i. a rectangular key top held within each rectangular channel, ii. a key shaft extending downward from the key top through an access hole, and iii. a key tip attached to the key shaft opposite the key top, said key tip being suitable for depressing a string against the fingerboard when the key is pressed, and e. positioning means for raising the key to an original position not touching a string when the key is not pressed, f. further comprising a thumb lever mechanism for depressing at least one key by engaging said thumb lever mechanism with a user's thumb, said thumb lever mechanism comprising:

i. thumb lever compartment attached to a side of said plate, said compartment having opposing compartment sides with matching holes formed in each compartment side, ii. a thumb lever rod extending through said matching holes in each compartment side, iii. at least one thumb lever comprising:

A. a thumb lever centerpiece having a top and a bottom, said centerpiece having a hole formed therein suitable for receiving said thumb lever rod so that said thumb lever pivots around said thumb lever rod, B. a thumb lever tip extending from said top of said thumb lever centerpiece so that said thumb lever tip presses a key adjacent to said thumb lever when the thumb lever is pivoted around the thumb lever rod, and C. a thumb lever activator extending from said bottom of said thumb lever centerpiece suitable for engaging with a user's thumb, so that engaging said thumb lever activator causes the thumb lever to pivot around said thumb lever rod, causing said thumb lever tip to press the key adjacent to said thumb lever, thereby depressing a string below said adjacent key.

9. A keyboard for depressing strings of a stringed instrument having a fingerboard with frets, comprising:

a. a plate securely suspended above the fingerboard of the stringed instrument, said plate having a bottom above the fingerboard, a top opposite thereto, and two sides, b. said plate having a plurality of rows, each row having dimensions corresponding to an area of the fingerboard beneath that row between adjacent frets of the fingerboard, c. each said row having one access hole formed therein above each string of the stringed instrument, said access holes arranged so that a first set of access holes in each row is positioned substantially near a fret and a second set of access holes in each row is positioned substantially mid-way between two frets, such that for each pair of adjacent strings, one string can be accessed through an access hole which is positioned substantially near a fret and the other string can be accessed through an access hole which is positioned substantially mid-way between two frets, d. a plurality of keys arranged within rectangular channels formed in adjacent positions in said top of said plate, each key comprising:

i. a rectangular key top held within each rectangular channel, ii. a key shaft extending downward from the key top through an access hole, and iii. a key tip attached to the key shaft opposite the key top, said key tip being suitable for depressing a string against the fingerboard when the key is pressed, and e. positioning means for raising the key to an original position not touching a string when the key is not pressed, f. having a thumb lever mechanism for depressing at least one key by engaging said thumb lever mechanism with a user's thumb adjacent to each strip of access holes.

* * * * *